United States Patent [19]

Hinchcliffe et al.

[11] 3,985,252

[45] Oct. 12, 1976

[54] FEEDING ROD-LIKE ARTICLES

[75] Inventors: Dennis Hinchcliffe, London; Tom Rowlands, Keston, both of England; James George Edward Hillman, deceased, late of Bromley, England, by Alice Lilian Hillman, executrix

[73] Assignee: Molins Limited, London, England

[22] Filed: June 2, 1975

[21] Appl. No.: 583,214

Related U.S. Application Data

[63] Continuation of Ser. No. 351,945, April 17, 1973, abandoned.

[52] U.S. Cl. ..... 214/302; 53/236; 198/627; 198/689

[51] Int. Cl.[2] ..... B65G 65/04

[58] Field of Search ..... 214/17 D, 302, 303, 214/307, 313, 314; 53/236; 198/56, 57, 20 C, 102, 165, 184; 271/197

[56] References Cited

UNITED STATES PATENTS

| | | | |
|---|---|---|---|
| 2,965,215 | 12/1960 | Molins | 198/165 |
| 3,477,558 | 11/1969 | Fleischauer | 271/197 |
| 3,486,647 | 12/1969 | Seragnoli | 214/302 |
| 3,503,487 | 3/1970 | London | 198/57 |
| 3,529,713 | 9/1970 | Poupin | 198/184 |
| 3,633,735 | 11/1972 | Molins et al. | 198/102 |
| 3,703,971 | 11/1972 | Rowlands | 214/302 |

FOREIGN PATENTS OR APPLICATIONS

| | | | |
|---|---|---|---|
| 1,335,615 | 7/1962 | France | 214/17 D |

*Primary Examiner*—Robert J. Spar
*Assistant Examiner*—Lawrence J. Oresky
*Attorney, Agent, or Firm*—John C. Smith, Jr.

[57] ABSTRACT

Apparatus for feeding cigarettes downwards transversely to their lengths, between vertical side walls, comprises two feed conveyors extending towards and moving towards one another from below the respective side walls, leaving a space between the inner ends of the conveyor, and delivery means (preferably a conveyor) extending from below the space between the two feed conveyors to carry the cigarettes away. The feed conveyors are preferably porous bands and suction is applied below them so as to grip the cigarettes adjacent to the feed conveyors.

25 Claims, 6 Drawing Figures

FEEDING ROD-LIKE ARTICLES

This is a continuation of application Ser. No. 351,945 filed Apr. 17, 1973 now abandoned.

This invention concerns feeding rod-like articles, and in particular cigarettes or similar rod-like articles, from a hopper or an inverted tray, for example to feed cigarettes into cigarette packing machines. For convenience reference will be made generally to "cigarettes," but it should be understood that this term is intended to include similar rod-like articles, for example cigarette filter rods and rod-like smokable articles other than cigarettes.

A method and apparatus for unloading trays of cigarettes and for feeding the cigarettes away is described in British patent specification No. 1,191,342. With that apparatus the tray to be unloaded is received in an upright position and inverted to an upside-down position, thus allowing cigarettes in the tray to pass through the open top of the tray. A substantially horizontal platform supports each batch of cigarettes as it moves down out of its tray and carries a plate which contacts the top surface of the previous batch (i.e., the batch of which the bottom is being fed away) so as to maintain the top surface level. According to specification No. 1,191,342 the cigarettes are fed substantially continuously from the hopper.

British patent specification No. 1,284,873 describes apparatus which is a modification of that described in specification No. 1,191,342. According to this specification the cigarettes are fed from the hopper to a reservoir. A continuous stream of cigarettes is withdrawn from this reservoir, but the supply of cigarettes from the hopper to the reservoir is discontinued during each period while a new tray-load of cigarettes is being prepared for discharge through the hopper.

U.S. Pat. No. 3,759,408 in the name of Tom Rowlands et al, describes a further modification. According to the modification, instead of the cigarettes being emptied from the tray into a hopper, each successive tray is inverted directly over the discharge position, and the cigarettes are discharged substantially directly from the tray onto the conveyor. The plate which constrains the top surface of each successive batch moves down through each tray in turn.

In each of these three arrangements the cigarettes are fed away from the discharge position by two horizontal conveyor bands arranged in tandem. The first band extends from under the upstream wall of the tray, or hopper, to a position about halfway across the tray, and the second band extends from that position and outwards under the downstream wall of the tray or hopper and carries the cigarettes away. The first band is positioned slightly higher than the second band and there is a bridging plate between the two bands. The first band runs at a slower speed than the second band.

According to the present invention apparatus for feeding cigarettes downwards transversely to their lengths, between vertical side walls, comprises two feed conveyors extending towards and moving towards one another from below the respective side walls, leaving a space between the inner ends of the conveyor, and delivery means (preferably a conveyor) extending from below the space between the two feed conveyors to carry the cigarettes away. The feed conveyors are preferably porous bands and suction is applied below them so as to grip the cigarettes adjacent to the feed conveyors.

The feed conveyors preferably moves in downwardly inclined directions.

Preferably the delivery conveyor comprises a porous band and suction is applied below it to grip the cigarettes adjacent to it. There is preferably also a top band which is parallel to the delivery band and is driven in the same direction and at the same speed to confine the upper surface of the stack of cigarettes on the delivery band.

Alternatively, the two feed conveyors, or the delivery conveyor, or both, may comprise bands having protrusions on them to assist in moving forwards the larger of cigarettes in contact with the bands. The bands may be as described in U.S. patent application Ser. No. 408,256 filed Oct. 23, 1973 in the name of D. W. Molins et al.

In a preferred embodiment of the invention, apparatus for feeding cigarettes out of a succession of rectangular trays comprises means for supporting each tray above two air-pervious feed conveyors extending and moving towards one another from beneath the respective side walls of the tray and inclined downwards, leaving a space between the inner ends of the feed conveyors for the cigarettes to pass through; means for applying suction beneath the bands to grip cigarettes adjacent to the feed conveyors; a delivery conveyor extending substantially horizontally from beneath the said space to carry away a stack of cigarettes transversely to their lengths, and includes a top band which runs parallel to and at the same speed as the delivery conveyor and confines the top surface of the stack of cigarettes; and the feed conveyor above the delivery conveyor comprises two laterally spaced bands, the said top band fitting between the two laterally spaced bands.

An example of a preferred embodiment will now be described with reference to the accompanying drawings; in the drawings.

Figure 1:
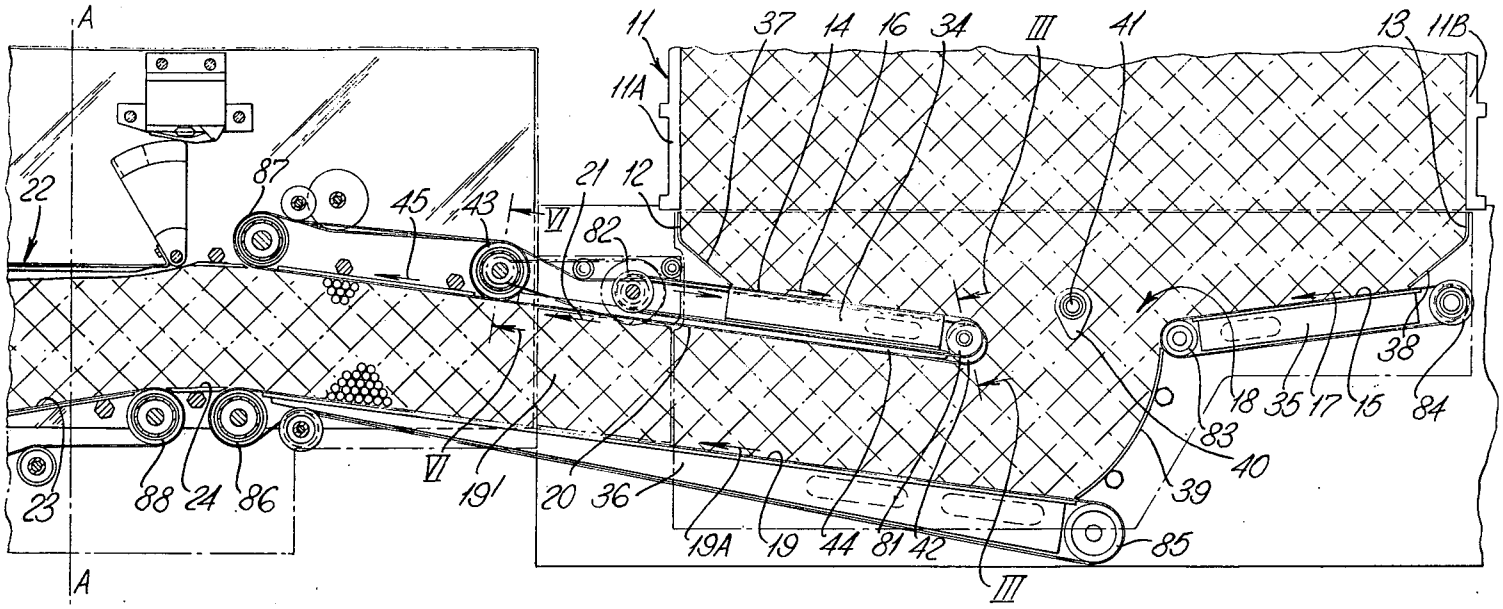
FIG. 1 is a diagrammatic side view of part of a tray unloader embodying the invention.

FIG. 1 shows the out-feed arrangement of a tray unloader somewhat similar to that described and shown in U.S. Pat. No. 3,759,408 mentioned above. The out-feed arrangement shown in FIG. 1 replaces the bands 106, 107, and 109 shown in FIG. 5 of the drawings of U.S. Pat. No. 3,759,408.

Reference will now be made to the accompanying drawings; as can be seen in FIG. 1, an inverted tray 11, having vertical side walls 11A and 11B, rests on walls 12 and 13 over two feed conveyors 14 and 15 respectively. Conveyor 14 passes round pulleys 81 and 82, and is driven in the direction of arrow 16. Conveyor 15 passes round pulleys 83 and 84, and is driven in the direction of arrow 17 at the same speed as the conveyor 14. There is a space 18 between the inner ends of the conveyors 14 and 15 through which cigarettes can pass from tray 11 to a delivery conveyor 19 passing round pulleys 85 and 86. The conveyor 19 is driven in the direction of arrow 19A. A further conveyor 20 passing round pulleys 42 and 43 and with its bottom run parallel to the top run of the conveyor 19, is driven in the direction of arrow 21, at the same speed as the conveyor 19.

Figure 3:
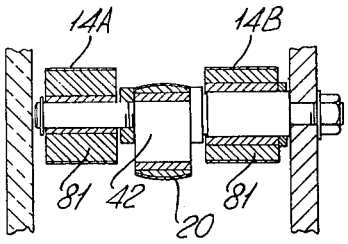
FIG. 3 is a section on the line III-III of FIG. 1.

As can be seen from FIG. 3, the feed conveyor 14 is made up of two parallel spaced bands 14A and 14B, and the conveyor 20 is a single band running between the two bands 14A and 14B. The conveyors 19 and 20 between them feed a stack of cigarettes 19' from the space 18 towards a reservoir 22. A further conveyor 45, comprises two spaced bands 45A and 45B, passes round the pulley 43 and a pulley 87. As can be seen from FIG. 6, the pulley 43 comprises three parts 43A, 43B, and 43C mounted on a common axis. The two outside parts 43A and 43C carry the bands 45A and 45B respectively, and the middle part 43B carries the conveyor 20.

The two conveyor bands 45A and 45B serve to grip the stack of cigarettes 19' more firmly than the band 20. The stack 19' is thus positively driven into the reservoir 22 between the conveyor 19 and the bands 45A and 45B. For his purpose, the conveyor 45 may be set slightly lower than the conveyor 20 so that the stack is gripped more firmly by the higher pressure exerted on it by the conveyor 45. If an equivalent force were exerted on the stack by the convex sectioned band 20, the cigarettes in contact with the band might be damaged, especially if the cigarettes concerned are not very firmly filled.

Figure 2:
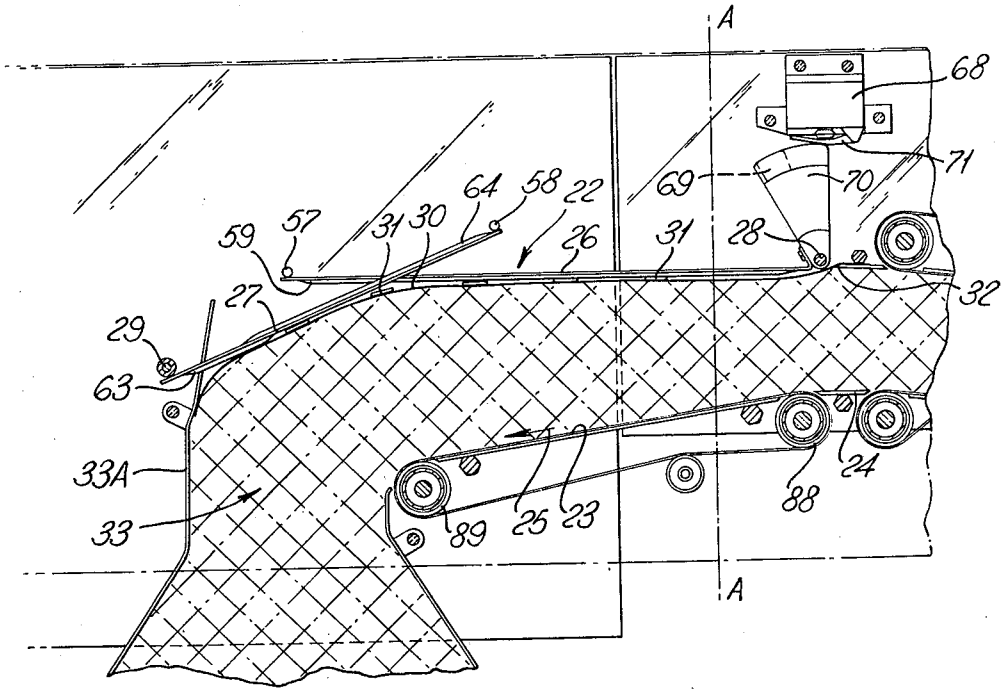
FIG. 2 is a side view of a reservoir associated with the tray unloader of FIG. 1.

The reservoir 22 is shown in FIG. 2. A vertical chain-dotted line A—A is shown in corresponding positions in FIGS. 1 and 2 to indicate the degree of overlap between the two figures. A further band 23 passing round pulleys 88 and 89 forms the floor of the reservoir 22, and a bridging plate 24 bridges the gap between the band 19 and the band 23. The band 23 is driven in the direction of arrow 25.

The top of the reservoir is formed by two arms 26 and 27 pivotally mounted at 28 and 29 respectively. A flexible strap 30 with weights 31 on it is anchored at 32 and serves to provide a smooth even surface for the cigarettes at the top of the reservoir 22. The reservoir has an outlet 33 through which the cigarettes are discharged from the reservoir to, for example, a packing machine.

While a tray 11 is being unloaded, the cigarettes are fed from the tray into the reservoir at a slightly faster rate than the rate at which they are withdrawn through the outlet 33. Thus the volume of cigarettes in the reservoir 22 increases, and the arms 26 and 27 swing upwards to accommodate this. When the tray 11 is empty, the supply of cigarettes to the reservoir 22 is arrested by stopping the bands 14A and 14B, 15, 19, 20 and 45 while the empty tray is being removed and a new tray is being brought into position. The conveyor 23 continues to run and the volume of cigarettes in the reservoir 22 decreases as cigarettes continue to be withdrawn through the outlet 33 and the arms 26 and 27 therefore swing downwards so as always to rest on the cigarettes in the reservoir 22.

Referring to FIGS. 1 and 3, the conveyor bands 14A, 14B, 15 and 19 are all porous and are provided with suction boxes by means of which suction is applied beneath the respective working runs of the bands. The bands 14A and 14B are associated with a suction box 34, band 15 with a suction box 35, and band 19 with a suction box 36. All of the suction boxes 34, 35, 36 are connected to a source of suction (not shown). The suction grips the the layer of cigarettes adjacent to the band, with consequently an appreciable reduction in the tendency for cigarettes to roll relative to the band.

Figure 6:
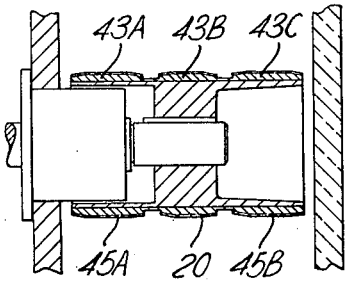
FIG. 6 is a section on the line VI—VI of FIG. 1.

Referring to FIGS. 3 and 6, it will be noted that the band 20 has a convex section. A stack of filter-tipped cigarettes is frequently not of uniform height across its width since the tobacco and filter portions are often of slightly different diameters or firmness, or both. Usually the filter portion is firmer, and possibly slightly larger, than the tobacco portion. Consequently the side of the stack containing the filter ends of the cigarettes is higher than the other side. Because of this the top row of the stack of cigarettes carried by the band 19 may not be parallel to the band 19, but inclined to it at a small angle. Since the band 20, which is in contact with the top row, has a convex section, there is a smooth surface for the cigarettes to contact. This reduces the likelihood of damage to the cigarettes which might otherwise occur if the band 20 was flat so as to have its edge in contact with the sides of the cigarettes. The band 20 is given the convex section by appropriately shaped pulleys 42 and 43B and a backing plate 44. The band 20 is made from a woven material so that it can easily be formed to the convex section.

As can be seen in FIG. 1, the side walls 12 and 13 have portions 37 and 38 respectively which slope inwards and downwards towards the conveyors 14 and 15, thus helping to provide a smooth flow of cigarettes out of the tray 11 towards the space 18. Beneath the space 18 is a curved back plate 39 which guides the cigarettes passing through the space 18 in a smooth flow to the bands 19 and 20.

In the space 18 between the conveyors 14 and 15 is a vane 40 mounted on a shaft 41 about which it is free to pivot. This tends to smooth the flow of cigarettes through the space 18 and helps to provide a uniform withdrawal of cigarettes from across the width of the tray 11. The vane 40 also acts to support some of the weight of the cigarettes in the tray 11, so that the cigarettes in the stack 19' beneath the space 18 are not subjected to too great a pressure.

Figure 4:
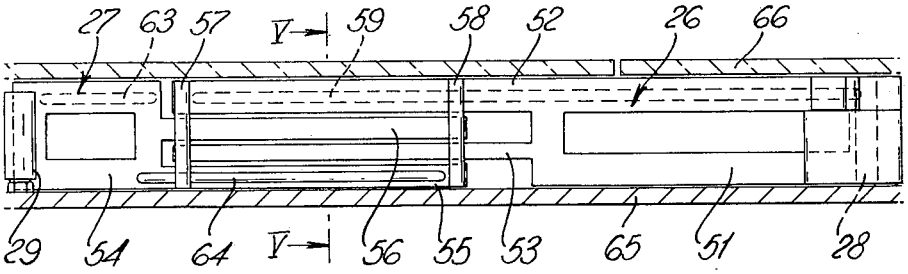
FIG. 4 is a plan view of the reservoir of FIG. 2.

The reservoir 22, shown in FIGS. 2, 4 and 5, will now be described in more detail. As can be seen in FIG. 4, the arm 26 comprises a body portion 51 and two parallel spaced legs 52 and 53. Similarly, the arm 27 comprises a body portion 54 and legs 55 and 56. A rod 57 is fixed across the ends of the legs 52 and 53 and a rod 58 is fixed across the ends of the legs 55 and 56. The pairs of legs 52 and 53 of arm 26, and 55 and 56 of arm 27, are arranged to fit inside each other as shown in FIG. 4.

On the underside of the leg 52 is a rib 59 which takes up the difference in height between the side of the stack of cigarettes containing the tobacco ends and the side containing the filter ends referred to earlier. A stack of cigarettes 60 is shown in FIG. 5; each cigarette has a tobacco end 61 and a filter end 62. On the underside of the body portion 54 of the arm 27 is another rib 63 in line with the rib 59. The rib 63 performs the same function where the cigarettes contact the arm 27 as does the rib 59 where the cigarettes contact the arm 26. This can be seen more clearly in FIG. 2. A further rib 64 is formed on top of the leg 55 over the length of the arm 27 not having the rib 63. The rib 64 thereby gives to the arm 27 a similar stiffness and weight to the arm 26 and both arms therefore exert a similar pressure on the cigarettes.

Figure 5:
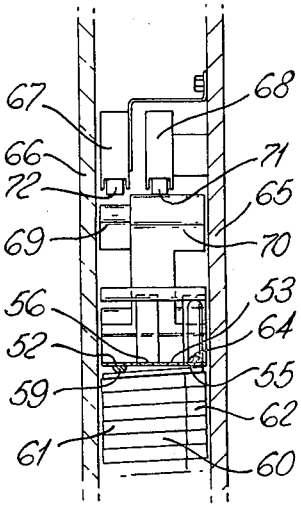
FIG. 5 is a section on the line V—V of FIG. 4.

As can be seen in FIGS. 4 and 5, the reservoir 22 has a front wall 65 and a back wall 66 spaced apart by slightly more than a cigarette length. The walls may be of a transparent material.

As described previously, the arms 26 and 27 pivot upwards to accommodate more cigarettes in the reservoir 22 and downwards to accommodate fewer cigarettes. Associated with the arms 26 are two switches 67 and 68. The switch 67 is actuated when the reservoir is full and halts the supply of cigarettes to the reservoir by causing the conveyors 14, 15, 19, 20 and 45 to stop. The conveyor 23 runs all the time that cigarettes are withdrawn from the reservoir 22. The switch 68 is actuated when the arms 26 and 27 are at their lowermost position and no more cigarettes may be withdrawn from the reservoir 22 without causing voids in the stack of cigarettes. The switch 68 serves to prevent any more cigarettes from being withdrawn; for example the switch 68 may cause the packing machine, which is fed from the reservoir 22, and the conveyor 23 to be stopped.

The switches 67 and 68 are operated respectively by cams 69 and 70 carried by the arm 26. The cam 70 is a wedge shaped piece fixed to the arm 26 and pivots with the arm 26 about the pivot 28. The cam 70 is positioned so that it presses inwards on operating lever 71 on the switch 68 at all times except when the arm 26 is in its lowermost position. In this position the cam 70 allows the lever 71 to move outwards and actuate the switch 68. The reservoir is shown in FIG. 2 with the arms 26 and 27 very nearly at their lowermost working positions, and the switch 68 is just about to be actuated. The cam 69 is carried on the cam 70 and is positioned so that the cam 69 is normally clear of an operating lever 72 of the switch 67, so that the operating lever 72 remains normally in the outward position. When the reservoir 22 is nearly full, the cam 69 is brought into contact with the lever 72 by the upward movement of the arm 26. The cam 69 then urges the lever 72 inwards and actuates the switch 67, thereby stopping the supply of cigarettes to the reservoir 22.

The following speeds for the various conveyors has been found to be satisfactory for a distance between the conveyors 19 and 20 of 100 mm, and a nominal cigarette diameter of 8 mm. X is the required output from the reservoir 22, measured in cigarettes per minute.

| | |
|---|---|
| Conveyors 14 and 15 | X/100 inches/minute. |
| Conveyors 19, 20 and 45 | X/33.3 inches/minute. |
| Conveyor 23 | X/40 inches/minute. |

As an example, X may be approximately 4000 cigarettes per minute or, more generally, in the range 2000 to 10,000 cigarettes per minute.

Conveniently, the conveyors 14, 15, 19, 20 and 45 may all be geared together and driven from a common variable speed motor (not shown), and the conveyor 23 may be driven independently from a separate variable speed motor (also not shown). Thus the conveyors 19, 20 and 45, would be arranged to all be driven always at the same speed as each other, and conveyors 14 and 15 would each be driven always at one-third of the speed of conveyors 19, 20 and 45, while the speed of the conveyor 23 could be adjusted independently. Clearly, the conveyor 23 must not be driven faster than the conveyor 19, or voids will be created in the stack of cigarettes 19'. Basically, the conveyor 23 should be driven at a speed sufficient to satisfy the demand X, and the conveyors 19, 20 and 45 should be driven at a higher speed so that the difference in the two speeds is sufficient to accumulate the desired excess of cigarettes in the reservoir 22. If the demand X is likely to vary appreciably, the output from the reservoir 22 may be monitored and the speed of the conveyor 23 varied in accordance with the variations in the required output. The other conveyors would be driven at speeds corresponding to the maximum required output expected, and if the output were in fact less, then the reservoir 22 would fill more rapidly and the switch 67 would stop the conveyor 14, 15, 19, 20 and 45.

As was mentioned earlier, the bands 14A, 14B, 15 and 19 are porous and suction is applied beneath them to prevent the cigarettes in contact with them rolling with respect to the bands. Instead of this arrangement, these bands could all have wedge-shaped protrusions extending across them at regular intervals, as illustrated in U.S. patent application Ser. No. 408,256 mentioned above. In this arrangement the suction boxes 34 to 36 would no longer be required and the wedges on the band would serve to prevent the cigarettes from rolling. As is described in U.S. patent application Ser. No. 408,256, the pulleys carrying the band would have flanges of the same height as the height of the wedges on the bands. The protrusions lie within the flanges as the bands pass round the pulleys and the bands thus effectively disappear within the pulleys. The wedges are therefore not forced into the mass of cigarettes where the bands pass round the pulleys.

Instead of the tray unloader feeding only one outlet 33, it could be associated with a number of spaced apart outlets. In this case the top part of wall 33A, which is the wall of the outlet 33 remote from the band 23, would be omitted to allow a stack of cigarettes to pass on beneath the pivot 29. This stack would be carried to the next outlet chute by a further, substantially horizontal, conveyor. Several such outlets could be arranged in series, the final one being of the form illustrated in FIG. 2, with a full height wall 33A. Each outlet could have associated with it a reservoir like the reservoir 22; and each reservoir could have switches corresponding to the switches 67 and 68. One switch, corresponding to 68, would act to stop the packing machine, or other device, associated with the respective outlet when the reservoir reaches its minimum-capacity condition. The other switch, corresponding to the switch 67, would act to stop the conveyor immediately upstream of the reservoir when the reservoir is full, thus cutting off the supply of cigarettes to that reservoir, while not interferring with the supply of cigarettes to any other reservoir upstream of that reservoir.

We claim:

1. Apparatus for feeding cigarettes transversely to their lengths out of a succession of rectangular trays having a plurality of side walls, said apparatus comprising means for supporting each tray at a discharge position; two feed conveyors arranged to extend and move towards one another from beneath respective side walls of the tray to provide a uniform withdrawal of cigarettes from across the width of the tray, each of the two feed conveyors comprising bands having protrusions on one side thereof to assist in moving forward the cigarettes adjacent to them transversely to their lengths and the confronting ends of the feed conveyors defining a space between them for the cigarettes to flow smoothly therethrough, the confronting ends of the feed conveyors including pulleys around which the corresponding bands pass, and means adjacent the pulleys for guiding the cigarettes at a position spaced from said bands in the vicinity of said pulleys; and delivery means extending from below said space and arranged to carry the cigarettes away as a stack transversely to their lengths.

2. Apparatus according to claim 1 in which the feed conveyors are porous, and including means to apply suction beneath the feed conveyors so as to grip the cigarettes adjacent to the feed conveyors.

3. Apparatus according to claim 1 in which the feed conveyors are arranged to move in downwardly inclined directions.

4. Apparatus according to claim 1 in which the delivery means comprises a substantially horizontal delivery conveyor band adapted to carry the cigarettes away as a stack.

5. Apparatus according to claim 4 in which the delivery band is porous, and including means to apply suction beneath the delivery conveyor band so as to grip the cigarettes adjacent to the delivery conveyor band.

6. Apparatus according to claim 4, in which said delivery means further comprises a top band substantially parallel to, and spaced from, the delivery conveyor band, and arranged to be driven in the same direction and at the same speed as the delivery conveyor band, to confine the top surface of the stack of cigarettes on the delivery conveyor band.

7. Apparatus according to claim 1 further comprising a reservoir, said delivery means being arranged to carry said cigarettes to said reservoir.

8. Apparatus according to claim 1 including means for delivering to a discharge position above the feed conveyors a succession of substantially rectangular trays, each tray having vertical sides.

9. Apparatus according to claim 8 further comprising means to stop said delivery means while an empty tray is replaced by a full tray.

10. Apparatus for feeding cigarettes out of a succession of rectangular trays having a plurality of side walls, said apparatus comprising means for supporting each tray at a discharge position, two air-pervious feed conveyors arranged to extend and move towards one another from beneath respective side walls of the tray, and inclined downwardly, the confronting ends of the feed conveyors defining a space therebetween for the cigarettes to pass through; means for applying suction beneath the bands to grip cigarettes adjacent to the feed conveyors; and delivery means including a delivery conveyor extending substantially horizontally from beneath said space to carry away a stack of cigarettes transversely to their lengths, and including a top band spaced from and arranged to run parallel to and in the same direction and at the same speed as the delivery conveyor to confine the top surface of the stack of cigarettes, one of the feed conveyors being located over the delivery conveyor and comprising two laterally spaced bands, said top band being arranged between the two laterally spaced bands.

11. Apparatus according to claim 10 in which the portion of the top band in contact with the cigarettes has a convex backing member to constrain that portion to be convex in section.

12. Apparatus according to claim 10 in which the delivery conveyor is air pervious, and including means to apply suction beneath the delivery conveyor to grip the cigarettes in contact with it.

13. Apparatus for feeding cigarettes transversely to their lengths out of a succession of rectangular trays having a plurality of side walls, said apparatus comprising two feed conveyors, means for supporting each tray above the two feed conveyors, said feed conveyors extending and being arranged to move towards one another from beneath the respective side walls of the tray to provide a uniform withdrawal of cigarettes from across the width of the tray, the inner ends of the feed conveyors defining a space therebetween for the cigarettes to flow smoothly therethrough and comprising bands having protrusions on them to assist in moving forward the cigarettes adjacent to them transversely to their lengths; a delivery conveyor extending substantially horizontally from beneath said space to carry away a stack of cigarettes transversely to their lengths, and a top band spaced from and arranged to run parallel to and at the same speed as the delivery conveyor to confine the top surface of the stack of cigarettes, one of said feed conveyors being located over said delivery conveyor and comprising two laterally spaced bands, said top band being arranged between said two laterally spaced bands.

14. Apparatus according to claim 1 in which the delivery means comprises a substantially horizontal conveyor band having protrusions on one side thereof to assist in moving forward the layer of cigarettes on the band.

15. Apparatus according to claim 14 in which the inner side of the delivery band opposite said one side is formed with a series of teeth, said pulley around which the band passes including teeth adapted to engage and cooperate with said teeth on said band so as to assist in driving the band.

16. Apparatus according to claim 1 in which the inner side of each of the bands opposite said one side is formed with a series of teeth, said pulleys around which the bands pass including teeth adapted to engage and cooperate with said teeth on said bands so as to assist in driving the bands.

17. Apparatus according to claim 1 further comprising a reservoir, said delivery means being arranged to carry said stack of cigarettes to said reservoir.

18. Apparatus according to claim 17 further comprising means to stop said delivery means while an empty tray is replaced by a full tray on said support means.

19. Apparatus for feeding cigarettes out of a succession of rectangular trays having a plurality of side walls, said apparatus comprising means for supporting each tray in turn at a discharge position, two feed conveyors arranged to extend and to move towards one another from beneath respective side walls of the tray, and inclined downwards, the confronting ends of the feed conveyors defining a space between them for the cigarettes to pass through, the two feed conveyors comprising bands passing around pulleys and having protrusions on their outer sides to assist in moving forward the cigarettes adjacent to them, at least one pulley associated with each conveyor including a series of teeth and the inner side of each band including a series of teeth which are adapted to engage and cooperate with said teeth on said pulleys around which the bands pass so as to assist in driving the bands, the pulleys around which the confronting ends of the bands pass each having a relatively small-diameter part around which the corresponding band passes and at least one larger diameter part to guide the cigarettes adjacent to the pulley; and delivery conveyor means which is arranged to carry a stack of cigarettes transversely to their lengths away from beneath the space between the confronting ends of the feed conveyors towards a reservoir, said delivery conveyor means comprising a bottom conveyor including a substantially horizontal bottom band arranged to support and carry the stack and having protrusions on its outer side to assist in moving forward the layer of cigarettes in contact with it, and a top conveyor including a top band spaced from and arranged parallel to the bottom band and to be driven in the same direction and at the same speed as the bottom band and positioned so as to contact the top of the stack of cigarettes and assist in driving forward the stack, the outer side of the top band in contact with the cigarettes being convex in section, said bottom conveyor including at least one pulley including a series of teeth, and the inner side of the bottom band including a series of teeth which are adapted to engage and cooperate with said teeth on said pulley around which the bottom band passes to assist in driving the band.

20. Apparatus according to claim 19 further comprising a variable capacity reservoir, said delivery conveyor means being arranged to carry the stack of cigarettes towards said reservoir, the bottom band being arranged to pass around a pulley which has a relatively small-diameter part and said pulley including at least one larger diameter part to guide the cigarettes adjacent to the pulley, and means to stop said delivery conveyor means while an empty tray is replaced by a full one on said support means.

21. Apparatus for feeding cigarettes transversely to their lengths out of a succession of rectangular trays having a plurality of side walls, said apparatus comprising means for supporting each tray at a discharge position, two feed conveyors arranged to extend and move towards one another from beneath the respective side walls of the tray to provide a uniform withdrawal of cigarettes from across the width of the tray, the confronting ends of the feed conveyors defining a space therebetween for the cigarettes to flow smoothly therethrough, and delivery means extending from below the space between the two feed conveyors to carry the cigarettes away as a stack transversely to their lengths, said delivery means comprising a substantially horizontal delivery conveyor band adapted to carry the cigarettes away as a stack and a top band substantially parallel to, and spaced from, the delivery conveyor band and arranged to be driven in the same direction and at the same time as the delivery conveyor band to confine the top surface of the stack of cigarettes on the delivery conveyor band, and one of said feed conveyors above the delivery conveyor band comprising two laterally spaced bands, said top band being arranged between said laterally spaced bands.

22. Apparatus for feeding cigarettes out of a succession of rectangular trays having a plurality of side walls, said apparatus comprising means for supporting each tray at a discharge position; two feed conveyors arranged to extend and move towards one another from beneath respective side walls of the tray, each of the two feed conveyors comprising bands having protrusions on one side thereof to assist in moving forward the cigarettes adjacent to them transversely to their lengths and the confronting ends of the feed conveyors defining a space between them for the cigarettes to pass through; and delivery means extending from below said space and arranged to carry the cigarettes away as a stack transversely to their lengths; said delivery means comprising a substantially horizontal conveyor band having protrusions on one side thereof to assist in moving forward the stack of cigarettes on the band and a top band substantially parallel to, and spaced from, the delivery conveyor band and arranged to be driven in the same direction and at the same speed as the delivery conveyor band, to confine the top surface of the stack of cigarettes on the delivery conveyor, the portion of the top band for contacting the cigarettes being convex in section.

23. Apparatus for feeding cigarettes out of a succession of rectangular trays having a plurality of side walls, said apparatus comprising means for supporting each tray at a discharge position; two feed conveyors arranged to extend and move towards one another from beneath respective side walls of the tray, each of the two feed conveyors comprising bands having protrusions on one side thereof to assist in moving forward the cigarettes adjacent to them transversely to their lengths and the confronting ends of the feed conveyors defining a space between them for the cigarettes to pass through, the confronting ends of the feed conveyors including pulleys, each having a relatively small-diameter part around which the corresponding band passes and at least one larger-diameter part to guide the cigarettes adjacent to the pulley; and delivery means extending from below said space and arranged to carry the cigarettes away as a stack transversely to their lengths.

24. Apparatus for feeding cigarettes out of a succession of rectangular trays having a plurality of side walls, said apparatus comprising means for supporting each tray at a discharge position; two feed conveyors arranged to extend and move towards one another from beneath respective side walls of the tray, each of the two feed conveyors comprising a band having protrusions on one side thereof to assist in moving forward the cigarettes adjacent to them transversely to their lengths and the confronting ends of the feed conveyors defining a space between them for the cigarettes to pass through; and delivery means extending from below said space and arranged to carry the cigarettes away as a stack transversely to their lengths, said delivery means comprising a substantially horizontal conveyor bands having protrusions on one side thereof to assist in moving forward the layer of cigarettes on the band and a pulley having a relatively small-diameter part around which the conveyor band passes and at least one larger-diameter part to guide the cigarettes adjacent to the pulley.

25. Apparatus for feeding cigarettes transversely to their lengths out of a succession of rectangular trays having a plurality of side walls, said apparatus comprising means for supporting each tray at a discharge position; two feed conveyors arranged to extend and move towards one another from beneath respective side walls of the tray to provide a uniform withdrawal of cigarettes from across the width of the tray, each of the two feed conveyors comprising bands having protrusions on one side thereof to assist in moving forward the cigarettes adjacent to them transversely to their lengths and the confronting ends of the feed conveyors defining a space between them for the cigarettes to flow smoothly therethrough; and delivery means extending from below said space and arranged to carry the cigarettes away as a stack transversely to their lengths, said delivery means comprising a substantially horizontal conveyor band having protrusions on one side thereof to assist in moving forward the layer of cigarettes on the band and a top band substantially parallel to and spaced from said delivery conveyor and arranged to be driven in the same direction and at the same speed as said delivery conveyor to confine the top surface of the stack of cigarettes on said delivery conveyor, said feed conveyor over said delivery band comprising two laterally spaced bands, said top band being arranged between said laterally spaced bands.

* * * * *